United States Patent [19]

Vollmann et al.

[11] Patent Number: 4,594,305

[45] Date of Patent: Jun. 10, 1986

[54] LIQUID DEVELOPER AND CHARGE CONTROL SUBSTANCE SUITABLE THEREFOR

[75] Inventors: Hansjoerg Vollmann, Bad Soden; Heinz Herrmann, Wiesbaden, both of Fed. Rep. of Germany

[73] Assignee: Hoechst Aktiengesellschaft, Frankfurt am Main, Fed. Rep. of Germany

[21] Appl. No.: 743,817

[22] Filed: Jun. 12, 1985

[30] Foreign Application Priority Data

Jun. 15, 1984 [DE] Fed. Rep. of Germany ..... 3422304

[51] Int. Cl.[4] ..... G03G 9/12

[52] U.S. Cl. ..... 430/115

[58] Field of Search ..... 430/115

[56] References Cited

U.S. PATENT DOCUMENTS

| | | | |
|---|---|---|---|
| 3,542,682 | 11/1970 | Mutaffis | 252/62.1 |
| 3,844,966 | 10/1974 | Nelson | 430/115 |
| 4,423,736 | 1/1981 | Herrmann | 430/115 |

FOREIGN PATENT DOCUMENTS

| | | | |
|---|---|---|---|
| 3011193 | 10/1981 | Fed. Rep. of Germany . | |
| 55-95955 | 7/1980 | Japan | 430/115 |

*Primary Examiner*—Roland E. Martin

*Attorney, Agent, or Firm*—Schwartz, Jeffery, Schwaab, Mack, Blumenthal & Evans

[57] ABSTRACT

A liquid developer and a charge control substance for developing positively charged electrostatic charge images. The developer comprises an electrically insulating carrier liquid having a high resistance and a low dielectric constant and which contains a pigment or dye, a resinous binder, the charge control substance and conventional additives in dispersion or solution. The charge control substance is a negative-controlling graft copolymer soluble in an aliphatic hydrocarbon and is obtained by grafting a carboxylic acid N-alkenylamide onto polymers soluble in aliphatic hydrocarbons used as the carrier liquid. The carboxylic acid N-alkenylamide is a compound of the formula:

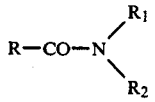

in which

R is hydrogen or $C_1$–$C_3$ alkyl, $R_1$ is hydrogen or $C_1$–$C_{20}$ alkyl, and $R_2$ is $C_2$–$C_4$ alkenyl.

9 Claims, No Drawings

LIQUID DEVELOPER AND CHARGE CONTROL SUBSTANCE SUITABLE THEREFOR

BACKGROUND OF THE INVENTION

The invention relates to a liquid developer for developing positively charged electrostatic charge images. The developer is composed of an electrically insulating carrier liquid which has a high resistance and a low dielectric constant and which contains a pigment or dye, a resinous binder, a charge control substance and conventional additives in dispersion or solution. The invention is also directed to a charge control substance suitable in the developer.

In electrophotography, transfer processes have largely gained acceptance in practice in which the toner particles of the developer, deposited on the latent electrostatic charge image, are transferred from the photoconductor layer to a suitable receiving material, for example normal paper, and are fixed. The development of the charge image can be carried out with a dry developer or liquid developer.

Liquid developers are in principle composed of electrically insulating carrier liquids, in which pigments and dyes, resins, charge control substances and conventional additives are dispersed or dissolved. In the electric field of the charge image, the charged toner particles of the liquid developer are deposited electrophoretically on the charge image. For positive charge images, such as are formed, for example, in the electrophotographic process on photoconductive, positively charged selenium layers, liquid developers with negatively charged toner particles are required. To ensure a satisfactory transfer from the photoconductor layers to the receiving material, the toner particles must be coarser than in the case of non-transferable toners such as are required, for example, for the development of charge images on zinc oxide binder layers.

The negative charge of the toner particles of a liquid developer is obtained either by applying electronegative resins or polymers, which are sparingly soluble in the carrier liquid, to the surface of the toner or pigment particles, or by dissolving a soluble basic substance in the carrier liquid.

Numerous charge control agents have been disclosed which are soluble in the carrier liquid and effect negative charging. These include, for example, lecithin, alkaline earth metal salts of long-chain alkylbenzenesulfonic acids and dialkylsulfosuccinic acids, superbasic calcium alkylsulfonates or polymers with dialkylamino groups. Particularly suitable polymers are those which are soluble in the carrier liquid and which contain N-vinylpyrrolidone groups, for example, alkylated polyvinyl pyrrolidones (U.S. Pat. No. 3,542,682), copolymers of N-vinylpyrrolidone and long-chain methacrylates (EP-B No. 0,001,103) and graft copolymers obtained by grafting 1 to 20% of N-vinyl-pyrrolidone onto soluble homopolymers or copolymers of methacrylates (German Offenlegungsschrift No. 3,011,193).

Long-life developer liquids providing good copies are obtained in particular with the last mentioned graft copolymers. However, the developers do not yet meet the most stringent demands and require improvement. Depending on the copying speed and the blackening on the original to be copied, they contaminate the copying machines to different extents or the toner image is not completely transferred to the receiving material. The toner still present on the photoconductor layer after the passage through the transfer station can no longer be redispersed in an optimum manner, after it has been stripped off from the photoconductor layer in the cleaning station, and can collect in an undesirable way in the cleaning station.

In the case of unfavorable copying conditions, for example, after the copying machine has been at a standstill for several days, the deposits can cause streaks on the copies to be made. The liquid developers themselves tend to gel on prolonged storage and are then unsuitable for controlled replenishment because they block the valves of the stock bottles.

SUMMARY OF THE INVENTION

It is accordingly an object of the invention to provide a liquid developer for developing positively charged electrostatic charge images, in which the described disadvantages are minimized or nonexistent.

Another object of the invention is to provide a liquid developer, as above, which shows excellent charge control coupled with a long storage life.

Yet another object of the invention is to provide a charge control substance which effects correspondingly good control.

The objects of the invention are achieved by a liquid developer of the type described herein above, wherein the charge control substance is a negative-controlling graft copolymer which is soluble in aliphatic hydrocarbons and is obtained by grafting a carboxylic acid N-alkenylamide onto polymers soluble in aliphatic hydrocarbons as the carrier liquid.

In general, a liquid developer for developing positively charged electrostatic charge images, according to the invention, comprises an electrically insulating carrier liquid having a high resistance and a low dielectric constant and consisting of one or more aliphatic hydrocarbons, pigments or dyes, a resinous binder, a charge control substance and conventional additives, wherein the charge control substance is a negative controlling graft copolymer soluble in an aliphatic hydrocarbon and obtained by grafting a carboxylic acid N-alkenylamide onto polymers soluble in the aliphatic hydrocarbons of the carrier liquid.

A charge control substance, according to the invention, comprises a graft copolymer soluble in aliphatic hydrocarbons, the graft copolymer comprising 1 to 20 percent by weight of a carboxylic acid N-alkenylamide grafted onto 99 to 80 percent by weight of a polymer selected from the group consisting of homo-, co-, ter- and quaterpolymers of acrylates and methacrylates having from 15 to 100 percent $C_8$ to $C_{20}$ alkyl groups. The graft copolymer is used for negatively charging pigment particles in electrostatic liquid developers.

DETAILED DESCRIPTION OF THE PREFERRED EMBODIMENTS

In a preferred embodiment of the invention, the carboxylic acid N-alkenylamide is a compound of the general formula

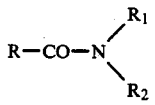

in which

R is hydrogen or $C_1$–$C_3$ alkyl, $R_1$ is hydrogen or $C_1$–$C_{20}$ alkyl and $R_2$ is $C_2$–$C_4$ alkenyl.

A carboxylic acid amide in which R and $R_1$ are methyl and $R_2$ is vinyl has proved particularly suitable.

The polymers soluble in aliphatic hydrocarbons, onto which the carboxylic acid N-alkenylamides are grafted, are preferably those based on acrylic or methacrylic resins. These are in particular homopolymers or copolymers which, to ensure good solubility, contain a considerable proportion (15 to 100%) of a $C_8$–$C_{20}$ alkyl acrylate or methacrylate, the remainder representing 0 to 85% of $C_1$–$C_7$ alkyl acrylate or methacrylate. These can also be terpolymers or quaterpolymers. However, grafting on other soluble polymers is also possible, such as long-chain alkyl vinyl ethers with, for example, $C_6$–$C_{20}$ alkyl groups, or polyvinyl stearates.

Preferably, the graft copolymers according to the invention contain about 1 to 20, in particular 2.5 to 10 percent by weight of carboxylic acid N-alkenylamide, relative to the graft copolymer.

Catalysts suitable for the graft polymerization are the compounds known for this purpose, such as azoisobutyrodinitrile (AIBN) or peroxides, such as benzoyl peroxide, dicumyl peroxide, lauroyl peroxide or t-butyl perbenzoate.

The graft polymerization is carried out in a known manner. The polymer, such as an acrylic resin as described above, is preferably dissolved in an aliphatic hydrocarbon, for example, a carrier liquid used for the liquid developer. The carboxylic acid N-alkenylamide and the catalyst are then added, and the mixture is flushed with nitrogen and heated under nitrogen to the decomposition temperature of the catalyst.

The polymerization can also be carried out in a non-aliphatic solvent. However, before the graft copolymer is used as a charge control substance, the solvent used must then be replaced by a solvent suitable as a carrier liquid.

A negative charge control effect is also found with normal copolymers which are soluble in aliphatic hydrocarbons and, for example, are composed of N-vinyl-N-methylacetamide (VIMA) and methacrylates. To preserve the solubility of the copolymers in aliphatics, methacrylates with $C_8$–$C_{20}$ alkyl radicals must be used and the VIMA content must be limited to values below 30%.

The charge control substance according to the invention is suitable for the preparation of all types of liquid developers. Thus, for example, pure carbon black can be dispersed in the polymer solution, and a fixer, such as soluble resins or polymer organosols and, if desired, a further quantity of charge control substance, may then be added. In place of the pure carbon black, types of carbon black which have been resin-treated, flushed or grafted with a polymer, or other pigments or pigment mixtures, can also be used. In every case, the charge control substances according to the invention effect an unambiguous negative charge of the toner particles.

By definition, the charge control substance according to the invention represents a graft copolymer which is soluble in aliphatic hydrocarbons and which is composed of 1 to 20 percent by weight of a carboxylic acid N-alkenylamide grafted onto 99 to 80 percent by weight of a homo-, co-, ter- or quaterpolymer of acrylates or methacrylates with a proportion of about 15 to 100% of $C_8$–$C_{20}$ alkyl groups, for negatively charging pigment particles in electrostatographic liquid developers. Alternatively, the carboxylic acid N-alkenylamide can also be grafted onto a long-chain alkyl vinyl ether polymer or onto polyvinyl stearate.

Suitable carrier liquids include the known aliphatic hydrocarbons used in liquid developers and having boiling points between 150° and 190° C. Crude oil distillation products (petroleum fractions) which are substantially odorless and commercially available may be mentioned as non-exclusive examples. These products represent various hydrocarbon mixtures with from about 8 to 16 carbon atoms. They have a high electrical resistance of more than $10^9$ ohm×cm and a low dielectric constant of approximately less than 3.

The developer liquid must be vaporizable at a sufficient rate, at vaporization temperatures which are lower than the temperature at which the normal paper, used as the receiving material, chars. Preferably, the developer liquid is substantially free of aromatic liquids and other constituents which may have a toxic or corrosive action. The developer liquid also has a sufficiently low viscosity, in order to allow rapid migration of the toner particles to the electrostatically charged image areas which are to be developed. The viscosity of the carrier liquid is between about 0.5 and 2.5 mPa.s at room temperature.

The pigments used according to the invention are known. Synthetic types of carbon black are as a rule used for the production of black developers. For brightening the color shade, the carbon black types can be mixed, for example, with blue pigments.

In principle, all organic and inorganic pigments and dyes can be used. The following may be mentioned as examples: Carbon Black (C.I. 77,266), Oil Blue (C.I. 61,555), Alkali Blue (C.I. 42,750), Phthalocyanin Blue (C.I. 74,160), Phthalocyanin Green (C.I. 74,260 or 42,040), Spirit Black (C.I. 50,415), Oil Violet (C.I. 60,725), Diaryl Yellow (C.I. 21,100), Methylorange (C.I. 13,025), Brilliant Carmin (C.I. 15,850) or Fast Red (C.I. 18,865).

The most diverse properties of the developer, for example, the charging level, the sedimentation behavior of the particles, the life of the developer, the redispersibility of agglomerates formed, the transferability of the toner particles and the wiping resistance of the fixed toner on the receiving material, can be influenced by the conventional additives which may be present.

The resinous binders and conventional additives used from case to case are (a) waxes, such as polyethylene waxes of montan waxes, or halogen-containing waxes, for example, chloroparaffin having a chlorine content of 70%; (b) polymers soluble in the carrier liquid, such as styrene/butadiene copolymers, polyvinyl alkyl ethers, polyisobutylenes, polyvinyl stearates and polyacrylates or polymethacrylates with $C_8$–$C_{20}$ alkyl groups; (c) resins soluble in the carrier liquid, such as hydrocarbon resins and polyterpene resins; (d) plasticizers, for example, dialkyl phthalates.

The content of waxes which may be added, in the liquid developer can vary within wide limits. Preferably, 0.1 to 1.5 parts by weight, in particular 0.3 to 0.8 part by weight, of wax are used per part by weight of pigment.

The weight ratio of the charge control substance according to the invention to pigment is not particularly critical. Relative to 1 part by weight of pigment or dye, preferably 0.5 to 5 parts by weight of charge control substance are used.

The polymeric charge substance according to the invention has an excellent control effect. The toner particles are maintained in dispersion, in an advantageous manner. Furthermore, the liquid developer according to the invention has a long storage life. The cleaning stations of the copying machines suffer considerably less contamination.

The invention is described in more detail by reference to the examples which follow, without restricting it thereto. The toner concentrates described in the examples which follow give, unless more details are given, liquid developers ready for use when diluted with 6 to 10 times the quantity of aliphatic hydrocarbon as the carrier liquid.

EXAMPLE 1

(a) Graft copolymer solution 1

300 g of a commercially available copolymer of 75 to 85% of isobutyl methacrylate, 15 to 25% of stearyl methacrylate and about 0.2% of methacrylic acid were dissolved in 700 g of an aliphatic hydrocarbon of boiling range 160° to 180° C. The solution was transferred into a four-necked 2 liter flask fitted with a stirrer, reflux condenser, thermometer and gas inlet tube. After the addition of 15 g of N-vinyl-N-methylacetamide (VIMA) and 3.0 g of dicumyl peroxide, the solution was flushed for 10 minutes with nitrogen. The mixture was then maintained in a nitrogen atmosphere for 6 hours at 120° C., with stirring. This gave a slightly turbid solution of graft copolymer.

(b) Toner concentrate 1

A paste of 180 g of acid carbon black having a carbon content of 95%, 54 g of β-copper phthalocyanine;

90 g of polyethylene wax having a mean molecular weight of 1,500;

400 g of the graft copolymer solution 1; and 1,250 g of an aliphatic hydrocarbon having boiling range 170° to 190° C.

was ground in a ball mill heated to 72° C.

A toner concentrate with negatively charged particles was obtained by diluting 1.78 kg of the ground material with 0.61 kg of the graft copolymer solution 1 and 5.49 kg of the above-mentioned aliphatic hydrocarbon.

After diluting the toner concentrate obtained with the above-mentioned aliphatic hydrocarbon in the ratio of 1:7, a liquid developer was obtained which, in a commercially available copying machine operating with normal paper as the receiving material, had excellent life and gave copies of good quality.

EXAMPLE 2

(a) Graft copolymer solution 2

Example 1 was repeated, with the difference that N-vinyl-N-methyl-formamide was used in place of VIMA. This gave a lightly turbid solution.

(b) Toner concentrate 2

50 g of montan ester wax having a dropping point of 78° to 86° C. and an acid number of 15 to 30 were dissolved in a warm mixture of 133 g of graft copolymer solution 2 and 480 g of aliphatic hydrocarbon having a boiling range 170° to 190° C. After the addition of 60 g of acid carbon black at 95% carbon content and 18 g of β-copper phthalocyanine, the mixture was ground for 3 hours at 80° C. in a stirred ball mill and diluted, while still in the mill, with 750 g of the hydrocarbon used above.

By diluting 750 g of the ground material with 600 g of aliphatic hydrocarbon and 200 g of graft copolymer solution 2 with intensive stirring, a toner concentrate with negatively charged toner particles was obtained.

EXAMPLE 3

(a) Graft copolymer solutions 3(*a*) and 3(*b*)

8 g of AIBN were added to a mixture of 400 g of dodecyl methacrylate and 600 g of aliphatic hydrocarbon of boiling range 170° to 190° C., and the mixture was flushed with nitrogen and then heated in a nitrogen atmosphere with stirring to 80° C. for 6 hours in the apparatus described in Example 1.

2 g of dicumyl peroxide and either 10 g of N-vinylpyrrolidone (NVP) or 10 g of VIMA were added to 500 g of each of the polydodecyl methacrylate solution formed, and the mixture was flushed with nitrogen and then stirred for 6 hours at 120° C. in a nitrogen atmosphere. The resulting graft polymer solutions 3(*a*) (NVP) and 3(*b*) (VIMA) showed slight turbidity.

(b) Toner concentrates 3(*a*) and 3(*b*)

The toner concentrate 3(*a*) was prepared using the graft copolymer solution 3(*a*), and the toner concentrate 3(*b*) was prepared using the graft copolymer solution 3(*b*):

60 g of acid carbon black of 95% carbon content, 18 g of β-copper phthalocyanine, 30 g of polyethylene wax of a mean molecular weight of about 1,500, and 4 g of chloroparaffin of about 70% chlorine content were pasted with:

75 g of graft copolymer solution 3(*a*) or 3(*b*) and 495 g of aliphatic hydrocarbon of boiling range 170° to 190° C.

The paste was in each case ground for 3 hours in a stirred ball mill at 80° C. and diluted, while still in the mill, with 750 g of aliphatic hydrocarbon.

750 g of each of the pigment dispersions formed were diluted with 60 g of the corresponding graft copolymer solution and 600 g of aliphatic hydrocarbon, to give the finished toner concentrate.

In a comparison of the two toner concentrates, diluted (ratio 1:10) to liquid developers, in a commercially available copying machine into which a damaged worn cleaning blade had deliberately been inserted, liquid developer 3(*a*) gave copies with faint streaks, but the liquid developer 3(*b*) according to the invention gave streak-free copies.

After storage for two weeks at a temperature of 55° C., only a little sediment had formed in both toner concentrates, but this was less in 3(*b*) than in 3(*a*).

EXAMPLE 4

(a) Graft copolymer solution 4

A four-neck 500 ml flask, fitted out as in Example 1, was charged with a solution of:

90 g of the copolymer mentioned in Example 1; and 210 g of aliphatic hydrocarbon having a boiling range 160° to 180° C.

After the addition of:

4.5 g of N-vinylformamide; and 0.9 g of dilauroyl peroxide, the mixture was flushed with nitrogen and then heated for 6 hours to 100° C. A turbid graft copolymer solution formed.

(b) Toner concentrate 4

210 g of a dispersion of:

60 g of carbon black, 20 g of β-copper phthalocyanine and 25 g of polyethylene wax having a molecular weight of about 1,500 in a solution of 24 g of a graft copolymer of dodecyl methacrylate, methyl methacrylate and N-vinylpyrrolid-2-one in 520 g of aliphatic hydrocarbon of boiling range 170° to 190° C.

were mixed with 15 g of graft copolymer solution 4.

The pigment particles, which originally were hardly charged electrostatically, showed definite negative charging after the addition of the graft copolymer solution 4.

A liquid developer obtained by diluting the toner concentrate with aliphatic hydrocarbon gave usable copies in a commercially available copying machine.

What is claimed is:

1. A liquid developer for developing positively charged electrostatic charge images, comprising:

an electrically insulating carrier liquid having a high resistance and a low dielectric constant and consisting of one or more aliphatic hydrocarbons;

pigments or dyes;

a resinous binder;

a charge control substance;

wherein said charge control substance is a negative-controlling graft copolymer soluble in an aliphatic hrdrocarbon and obtained by grafting a carboxylic acid N-alkenylamide onto polymers soluble in the aliphatic hydrocarbons of said carrier liquid.

2. A liquid developer as claimed in claim 1, wherein the carboxylic acid N-alkenylamide is a compound of the formula:

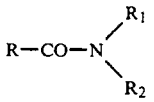

wherein

R is hydrogen or $C_1$–$C_3$ alkyl, $R_1$ is hydrogen or $C_1$–$C_{20}$ alkyl, and $R_2$ is $C_2$–$C_4$ alkenyl.

3. A liquid developer as claimed in claim 2, wherein R and $R_1$ are methyl and $R_2$ is vinyl.

4. A liquid developer as claimed in claim 1, wherein the polymer soluble in aliphatic hydrocarbons is a resin based on acrylates or methacrylates.

5. A liquid developer as claimed in claim 1, wherein the polymer soluble in aliphatic hydrocarbons is a homopolymer or copolymer of 15 to 100% of $C_8$–$C_{20}$ alkyl acrylate or methacrylate and 0 to 85% of $C_1$–$C_7$ alkyl acrylate or methacrylate.

6. A liquid developer as claimed in claim 1, wherein the polymer soluble in aliphatic hydrocarbons is a long-chain alkyl vinyl ether polymer.

7. A liquid developer as claimed in claim 1, wherein the polymer soluble in aliphatic hydrocarbons is a polyvinyl stearate.

8. A liquid developer as claimed in claim 1, wherein the charge control substance present is a graft copolymer containing from 1 to 20 percent by weight of a carboxylic acid N-alkenylamide, relative to the graft copolymer.

9. A liquid developer as claimed in claim 1, wherein the weight ratio of pigment or dye to the charge control substance is within the range from 1:0.5 to 1:5.

* * * * *